United States Patent [19]

Rose

[11] Patent Number: 4,907,794

[45] Date of Patent: Mar. 13, 1990

[54] FOLDABLE ROLLING WALKER

[75] Inventor: Eric P. Rose, Canoga Park, Calif.

[73] Assignee: Guardian Products, Inc., Arleta, Calif.

[21] Appl. No.: 137,769

[22] Filed: Dec. 24, 1987

[51] Int. Cl.[4] ..... A61H 3/00; A47D 13/04

[52] U.S. Cl. ..... 272/70.3; 297/5; 135/67; 280/43.24

[58] Field of Search ..... 272/70.3, 70.4, 93; 297/5, 6, 441; 135/67; 280/43.24

[56] References Cited

U.S. PATENT DOCUMENTS

| | | | |
|---|---|---|---|
| 188,885 | 3/1877 | Frederick | 297/6 |
| 1,917,440 | 7/1933 | Finkbeiner et al. | 135/67 |
| 2,450,051 | 9/1948 | Manning . | |
| 2,960,148 | 11/1960 | Murcott . | |
| 2,996,070 | 8/1961 | Ries . | |
| 3,098,651 | 7/1963 | Murcott . | |
| 3,194,577 | 7/1965 | Berlin . | |
| 3,237,940 | 3/1966 | Johnson | 272/70.3 |
| 3,273,888 | 9/1966 | Burns | 272/70.4 |
| 3,350,095 | 10/1967 | Clasen . | |
| 3,354,893 | 11/1967 | Schmerl . | |
| 3,397,883 | 8/1968 | Kiehn . | |
| 3,398,974 | 8/1968 | Edwards et al. . | |
| 3,778,052 | 12/1973 | Andow et al. . | |
| 3,872,945 | 3/1975 | Hickman . | |
| 3,945,389 | 3/1976 | Smith | 135/45 A |
| 3,999,228 | 12/1976 | Thomas . | |
| 4,018,440 | 4/1977 | Deutsch . | |
| 4,046,374 | 9/1977 | Breyley . | |
| 4,049,314 | 9/1977 | McGaffin | 297/441 |
| 4,086,932 | 5/1978 | Richardson . | |
| 4,094,330 | 6/1978 | Jong . | |
| 4,159,110 | 6/1979 | Dodenhoff . | |
| 4,164,354 | 8/1979 | Rodaway . | |
| 4,187,869 | 2/1980 | Marchetti . | |
| 4,188,966 | 2/1980 | Palmer . | |
| 4,211,309 | 7/1980 | Ruggiero . | |
| 4,211,426 | 7/1980 | Motloch . | |
| 4,251,044 | 2/1981 | Olson . | |
| 4,251,105 | 2/1981 | Barker . | |
| 4,253,678 | 3/1981 | Leclerc . | |
| 4,254,948 | 3/1981 | Jacobs . | |
| 4,261,804 | 4/1981 | Mueller . | |
| 4,272,071 | 6/1981 | Bolton . | |
| 4,277,100 | 7/1981 | Beougher | 135/67 |
| 4,289,156 | 9/1981 | Ulics . | |
| 4,332,378 | 6/1982 | Pryor . | |
| 4,341,381 | 7/1982 | Norberg . | |
| 4,342,465 | 8/1982 | Stillings . | |
| 4,384,713 | 5/1983 | Deutsch . | |
| 4,387,891 | 6/1983 | Knochel . | |
| 4,461,471 | 7/1984 | Brastow . | |
| 4,510,956 | 4/1985 | King . | |
| 4,620,608 | 11/1986 | Gilbreath | 280/43.24 |

OTHER PUBLICATIONS

The Wheel-A-Walk Advertisement Discloses a Rolling Walker with Adjustable Height Handles and Braking Action.

The American Walker Walk-A-Cycles Advertisement Discloses Rolling Walkers Having Adjustable Handles and Brakes.

The Odatt Medical Products, Inc. Advertisement Discloses Roling Walkers Having a Seat Which can be Raised and Lowered.

The Rollator Kombi Advertisement Discloses a Rolling Walker Having Adjustable Height Handles and Brakes.

The Uniscan Advertisement Discloses Rolling Walkers Which Fold and Provide Automatically-Locking Brake Action.

The DMA Advertisement Discloses Lightweight, Foldable Push Chairs.

*Primary Examiner*—Stephen R. Crow

*Attorney, Agent, or Firm*—Christie, Parker & Hale

[57] ABSTRACT

A foldable rolling walker having a high crossbar for easier walking convenience, height adjustable handles centered over offset wheels for greater stability, lockable pivoting front wheels and reversible brakes. The overall design is compact, lightweight and very stable. The walker includes a seat removably mounted between the side frames of the walker by collar clamps secured to the frame of the walker.

; 7 Drawing Sheets 26
51
24
31
32
30
53
32
24
31

FOLDABLE ROLLING WALKER

FIELD OF THE INVENTION

This invention pertains to the field of walking aids and, more particularly, to a rolling walker with a particularly stable and convenient design that can be folded into a compact flat configuration.

BACKGROUND OF THE INVENTION

The increasing number of elderly and handicapped who require assistance in walking has created new demands in the field of walkers. Most walkers have handles for the user to grasp which are incorporated into or mounted on a support frame. The design of the support frame must be lightweight, sturdy and stable and at the same time permit the free movement of the user's feet and legs. To further enhance its convenience, utility, and portability, it is also important that the walker be foldable into a compact flat configuration which can be conveniently tucked away in cars, restaurants and other public places. It has proven difficult in the past to satisfy all of these competing requirements, especially with rolling walkers which have the added complexity of wheels and brakes.

The present invention provides a frame design which overcomes many of the shortcomings of prior rolling walkers, which were either strong but bulky or compact but unstable. The present invention is lightweight and stable and folds into a virtually flat configuration. An expanded wheel base provides an extremely stable support for the user. The user's weight is centered and balanced evenly over all four wheels enhancing stability still further. Many important features have been added to this basic framework design making the walker still more advantageous as described below.

SUMMARY OF THE INVENTION

The present invention provides a rolling walker having an elevated horizontal cross brace and a side frame pivotally mounted at each end of the cross brace. The cross brace is mounted high and forward on the side frames. Each side frame has a front and a rear leg. The cross brace is located toward the front of the walker and includes a vertical sleeve at each side thereof, which receives the front leg of each side frame in a pivotable relationship. A wheel is attached to each leg of the side frames to support the walker on the ground. A handle assembly is mounted at the top of each side frame so as to position the handle substantially midway between the front and rear wheels for supporting the weight of the user. The front wheel is offset forward of the cross brace and the pivot axis of the side frames so that the user's weight is centered over the wheels.

The side frames pivot toward each other so that the walker can be folded substantially flat for storage or transit. The front wheels are pivotally mounted but can be locked into alignment with the rear wheels. The handles are vertically adjustable to accommodate the height of the user. The rear wheels include a brake mechanism which enables the brake pads to be alternately positioned so that the wheels are normally prevented from rolling unless the hand brakes are operated or the wheels allowed to roll unless the hand brakes are applied. A seat is optionally mounted between the side frames using seat pins at each corner that are received into the seat pin receptacles mounted on the front and rear legs of the side frames. The seat formed thereby extends between the side frames and the cross brace provides a backrest.

A number of aspects of the rolling walker according to the present invention provide important advantages and benefits. The front wheels of the present invention incorporate a caster pin-locking system. The heart of this system is a flip lever which moves between one position in which the front wheels are locked straight ahead, and a second position in which the wheels are unlocked and can free-wheel.

Still another advantage is that the push handles are freely adjustable without having to change any other component of the walker, including the components of the braking system. The push handles are formed from shaped tubes in which the lower portion of the tube telescopes into the frame. Knobs at the front of the walker unscrew, and removing the knobs allows the tubes to be raised and lowered to adjust the height. A physical therapist can thus specifically prescribe the height of each of the push handles. The range of heights obtainable by adjustment of the handles also means that the walker can be used by most users regardless of their actual height.

As has been indicated above, the brakes can be arranged so that the braking system operates on a squeeze-and-stop principle or a squeeze-and-go principle. In the latter, the brake acts like a deadman switch, so that if the user is weak and can't grasp the brake, the wheels immediately lock, and the user has a stable platform. The orientation of the brake pads at the wheels are reversed to obtain the two different braking approaches. To go from a squeeze-and-stop mode to a squeeze-and-go mode, the brake pads are removed, inverted and refastened on the walker.

Another advantageous aspect of the braking system according to the present invention is that the brake cable enters into the frames and passes interiorly through the tubing rather than exteriorly, adding to the clean lines and aesthetic appearance of the walker. Providing sufficient slack in the brake cables enables the handles to be adjusted up and down without the need to detach and reattach the brake cables.

The hand brake levers are cup-shaped and have a radius of curvature such that when the brake levers are operated, the handle portion of the push handle nests with the cup-shaped brake lever.

A walker according to the present invention, the walker has a completely open interior and puts the user directly in the center of the walker. This is in contrast to prior-art rolling walkers where the user is positioned to the rear of the center of the unit.

The preferred embodiment of the seat is a fabric sling supported by pins of each corner which crop into receptacles in housings clamped to the framework of the walker. The seat can also be of a more rigid material that folds, pivots or is removed entirely so that the walker can be folded.

Other structural features of importance are the provision of separate caster sockets for mounting the wheels. Such caster sockets are clamped externally to the frame of the walker, rather than incorporating wheel supports into the frame itself.

Prior-art rolling walkers are characterized by the problem that they are heavy and hard to fold. In most prior-art walkers so equipped, the brake lever throw is also quite long. Finally, in walkers that are provided with seats, most have no backrest.

The walker incorporating the above features is safer, easier and more convenient to use than prior-art designs. The frame structure is stronger and more stable than prior designs. It is also lightweight, compact and easy to move. These and other features allow the walker to be adapted to the particular needs of the user more quickly and more completely than prior designs.

BRIEF DESCRIPTION OF THE DRAWINGS

FIG. 6 is an exploded view of a rear wheel brake pad illustrating the manner in which the rear brake is reconfigured from normally OFF to normally ON;

DETAILED DESCRIPTION OF THE INVENTION

Figure 1:
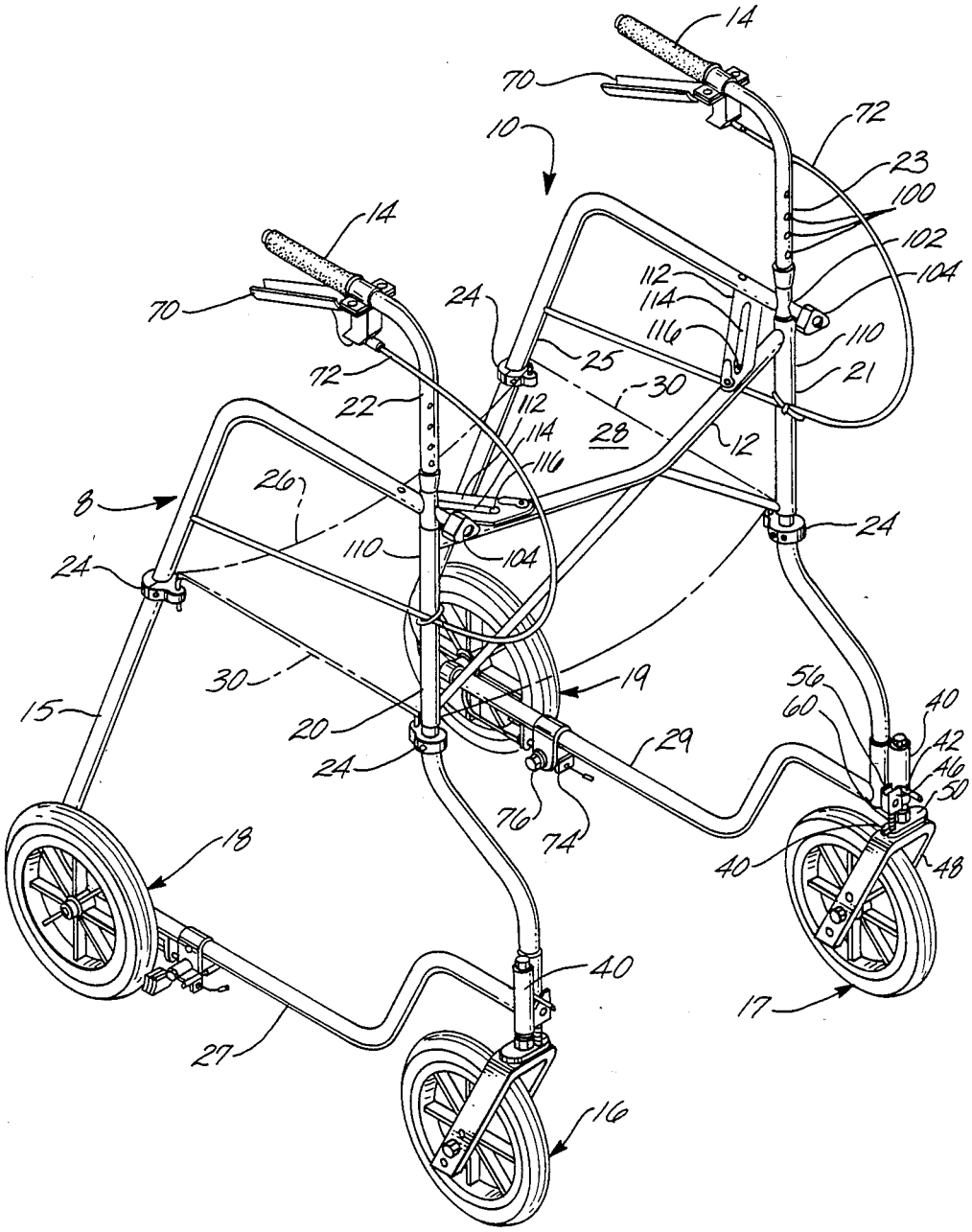
FIG. 1 is a perspective view of a rolling walker according to the present invention.

The preferred embodiment of the rolling walker according to the present invention is shown in perspective in FIG. 1. The walker includes two side frames 8 and 10 connected by a crossbar assembly 12. The side frames 8, 10 support push handles 14 and have front wheels 16, 17 and rear wheels 18 and 19, respectively, attached to the side frames of the base thereof. The frames are preferably made of an anodized aluminum tubing, but any lightweight, rigid material; for example, plastics or other metal alloys, could be used. In an alternate embodiment of the invention, particularly when the walker is intended to be used in rugged environments, the frames are constructed of heavy-duty steel or other stronger and more rugged materials.

Figure 8:
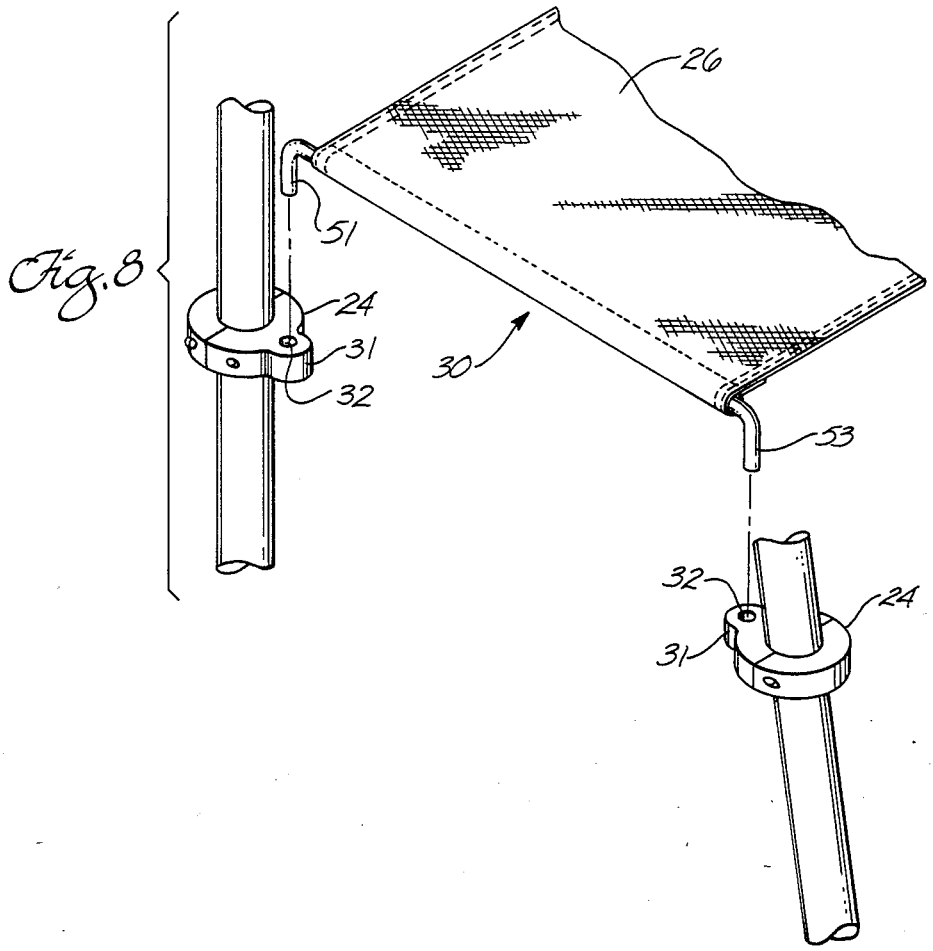
FIG. 8 is a detail side elevation view of the seat, seat collars and one side frame of the present invention.

The side frames are of a special unique design which allows for both greater stability and compact folding. The front legs 20, 21 of frames 8, 10 have a straight portion which receives the push handle tubes 22, 23 in a telescoping relation in and out of the side frames, as shown in FIG. 8. At the base, legs 20, 21 are offset away from the front of the walker and are angled sharply forward so that front wheels 16, 17 are located well forward of push handles 14 to provide a wide wheel base. In conventional walkers, the front wheels are located almost directly below the handles. This makes the walker easier to tip if the user inadvertently leans too far forward.

Rear wheels 18, 19 are mounted at the rear of the walker and attached to the side frames 8, 10 adjacent the junction of rear legs 15, 25 and lower horizontal braces 27, 29. The specific location of the rear wheels is chosen so that the push handles are centered between the front and rear wheels. While many walkers locate the push handles directly above the front wheels, other walker designs locate the push handles too far toward the rear of the walker. Both locations make the walker less stable.

The distance between the front and rear wheels is effectively determined by the width of the crossbar assembly 12. When the side frames are folded, as shown in FIG. 2B, the rear wheels are pivoted toward each other until they are essentially in line. The crossbar assembly bows outward slightly forming a space between the side frame 10 and the crossbar when the side frame 10 is folded. Side frame 8 and its rear wheel 18 fit into this area when folded which enables the walker to fold flat with the result that all four wheels are substantially aligned from front to rear of the walker. If the crossbar assembly were narrower, this space would be smaller, and side frame 8 would also have to be smaller in order to fold flat. The dimensions of the various components of the walker are scaled up or down on a relative basis, depending on the physical size and stature of the intended user. Thus, it is contemplated that there will at least be two primary size walkers, adult and child, for the present invention. Additional sizes for short or tall adults are also contemplated.

The upper vertical portions of legs 20, 21 define the pivot axes for the folding action of the side frames. In order to keep the push handles centered between the wheels, the distance between front and rear wheels is maintained at somewhat less than double the length of the crossbar. Such a configuration places the pivot axes of the side frames in the forward portion of the wheel base.

Clamped to the side frames are four seat pin collar supports 24. When the user becomes tired and wishes to rest, these seat pin collar or supports allow him to set up a seat 26 and rest. The seat is comprised of a flexible sheet material 28 such as canvas or any other similar material with support rods 30 sewn along each side. The support rods 30 have pins 51, 53 formed on each end, which fit into receptacles in the clamped collar pin supports 24. The result is a sturdy, lightweight sling seat extending between the side frames. While the preferred embodiment uses a flexible sheet material, other folding seat designs including a rigid bench support well known in the art could be used as well.

The seat in the present invention is a substantial improvement over prior art designs, in that the cross-brace being elevated and bowed forward, provides a convenient backrest. Many folding seat designs for invalids have no backrest whatsoever. The cross-brace can be padded for still greater comfort without substantially reducing the overall utility of the invention.

Figure 3A:
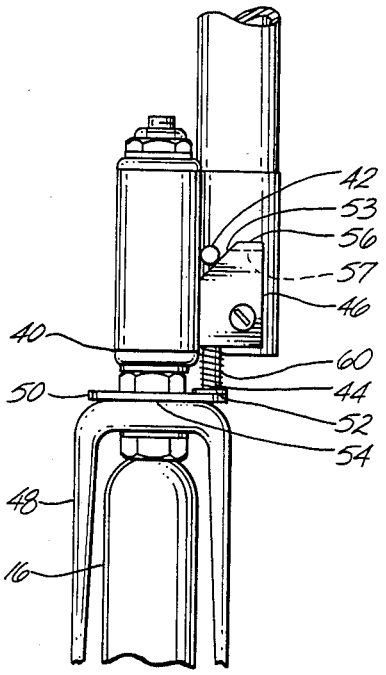
FIG. 3A is a front elevation detail view of the front wheel and wheel locking system when the wheel is unlocked.
Figure 3B:
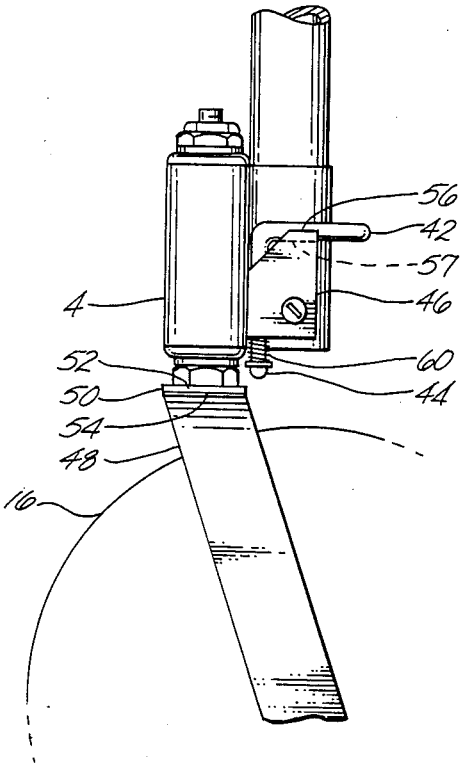
FIG. 3B is a front elevation detail view of the front wheel and wheel locking system when the wheel is locked.
Figure 4:
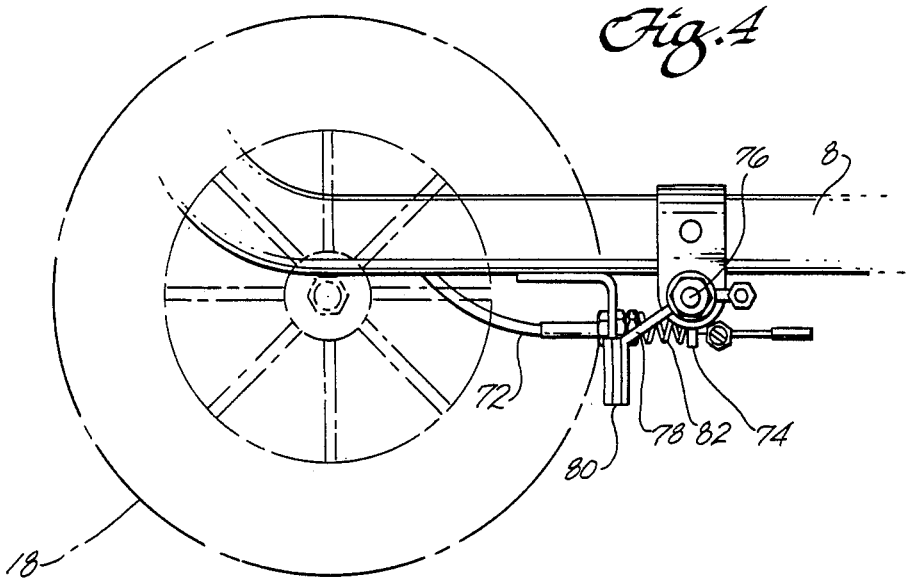
FIG. 4 is a side elevation detail view of a rear wheel and brake pad mechanism.
Figure 6:
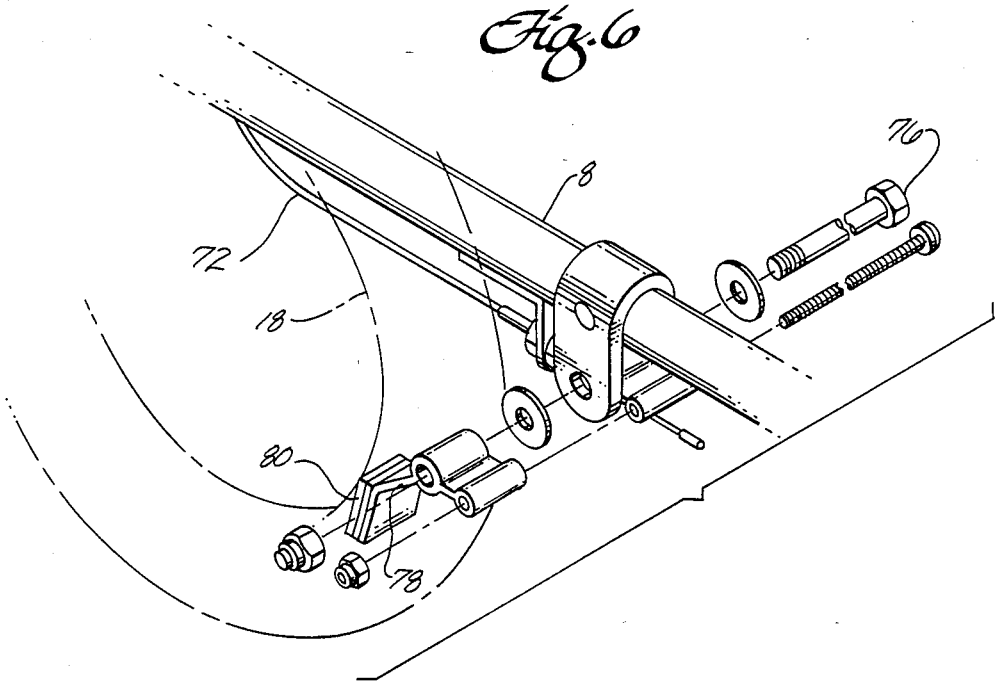

Referring to FIGS. 3A and 3B, front wheels 16, 17 are mounted to the side frames on casters 40 so that they swivel freely. This is a great convenience to users with reasonably good muscle control, as it is easier to steer the walker in the desired direction. However, if the user has poor muscle control or has become fatigued, the swiveling front wheels are a source of instability and make the walker difficult to control. In contrast to prior art designs, in the present invention, the wheels may be allowed to swivel freely or be locked in position with a simple flip of a locking lever 42.

In the forward position, lever 42 becomes a lock shaft which locks the front wheels 16, 17 in place. An extension of lever 42 runs through a housing 46 which is connected to the side frame. Front wheel 16 is rotatably mounted by forks 48 that end in a top plate 50. Top plate 50 has a hole 52 offset from the pivot point 54 of the front wheel. When wheel 16 is rotated to the forward position, hole 52 lies directly beneath the extension end of the lever 42. In the forward position, the extension reaches into hole 52 and wheels 16, 17 are locked in the forward direction. The extension is controlled by turning the lever 42. When the lever is turned forward as shown in FIG. 3A, it rests in the cleft 53 cut into the top surface 56 of housing 46. When lever 42 is rotated 90°, it rests in a curved slot 57 in the housing 46 as shown in FIG. 3B unlocking the wheels. A spring 60 against the bottom of the housing 46 and a ring around the extension biasing and holding the extension in the lowest position allowed by the lever and preventing the wheels from accidentally unlocking.

The rear wheels are equipped with a reversible cable actuated brake. The brakes are operated by unique cup shaped brake levers 70 which are easier to grip than conventional brake levers. Squeezing the brake levers 70 toward the handles 14 pulls the brake cables 72. The brake cables are enclosed within the hollow tubing of the walker throughout most of its length between the handles and the brake pods. The result is improved safety because the cable is less likely to catch on or snag on obstructions and an improved, less cluttered appearance of the walker. Sufficient slack is provided in the brake cables to enable adjustment of the push handles without requiring adjustment of the brake cables at the handles or the brake pads.

Figure 5A:
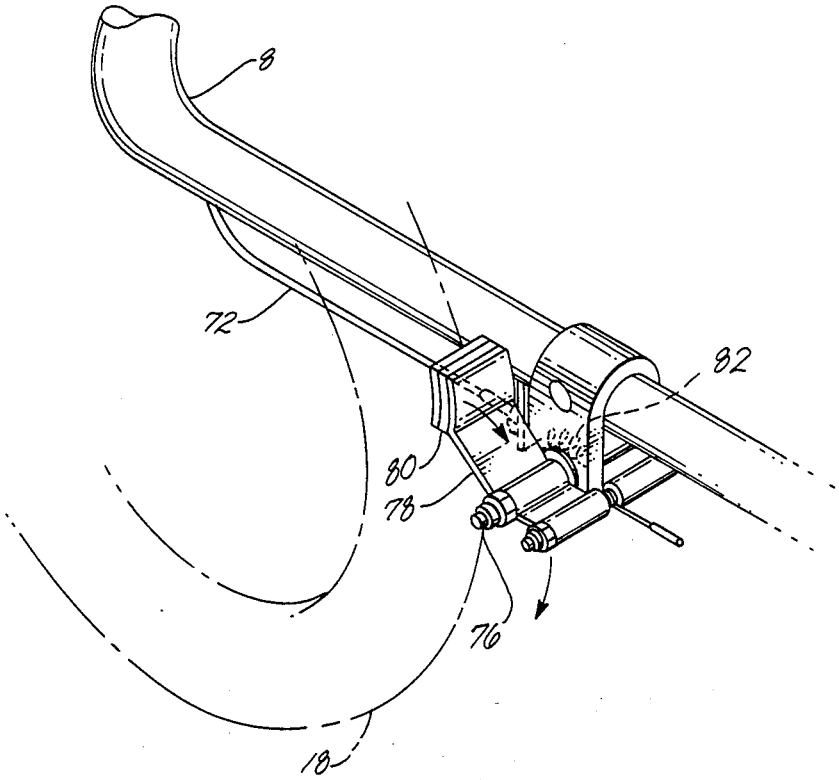
FIG. 5A is a perspective view of the rear wheel braking system with the brake pad configured in the normally ON position.
Figure 5B:
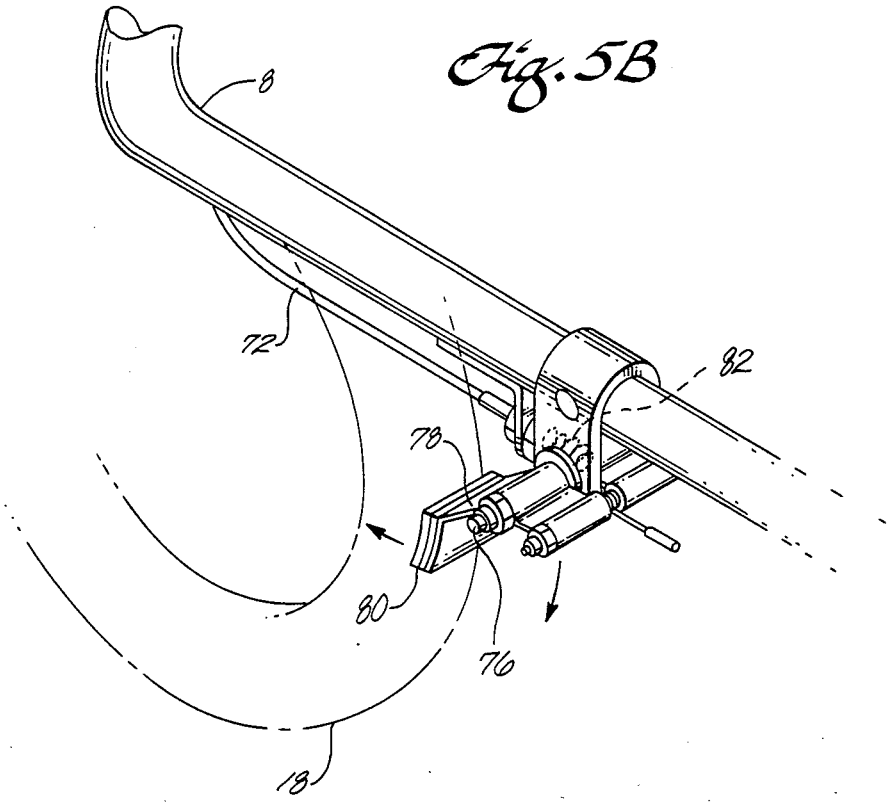
FIG. 5B is a perspective view of the rear wheel braking system with the brake pad configured in the normally OFF position.

In the preferred embodiment, the brake pads are mounted forward of the rear wheels so that the wheels can be mounted adjacent the rear of the side frames 8 and 10, as shown in FIGS. 5A and 5B. Pulling the cable therefore pulls a lever arm 74 rearward towards the rear wheel. This lever arm pivots on a central shaft 76 that is directly connected to the brake pad arm 78. The brake pad arm moves the brake pad 80 either against or away from the rear wheel tire. A coil spring 82 holds the brake pad in place when the cable is not being pulled. The amount of travel on the brake pull 70 required to activate the brakes is determined by the length of the levers 74 and 78. Preferably, the braking system is arranged with a very short amount of travel for the brake levers.

FIGS. 5A and 5B illustrate that the brake pad arm can be mounted in either of two positions on the central pivot. In FIG. 5A, brake pad arm is oriented so as to extend upwardly from shaft 76 when so positioned, a pull on the brake cable moves the brake pad away from the wheel. Coil spring 82 holds the brake against the wheel until the lever is pulled; the brake in this position is therefore normally on.

In operation, this arrangement of the brake is desirable if, for example, a user experiences sudden weakness. When the user becomes weak, his grip on the brake levers 70 loosens, actuating the brake, stopping the walker and providing a solid non-moving support. This arrangement of the brake is also desirable for a user who frequently uses the walker for support in standing up from a sitting position when the brake levers are hard to reach. It is also desirable for a user who stops and rests frequently.

As shown in FIG. 5B, the brake pad arm 78 is inverted and oriented so that it extends downwardly from shaft 76. In this position, spring 82 holds the brake pad away from the wheel. In this arrangement, a pull on the cable 72 pushes the brake pad 50 against the rear wheel tire, stopping the wheel. This is a desirable arrangement of the braking system for stronger, more mobile users who do not want to squeeze the brake lever constantly while walking but desire the capability of braking the wheels when the walker is to be stopped.

The brakes can be quickly placed in either configuration depending on the needs of the user. In a third alternative, one brake can be configured as in FIG. 5A, and the other as in FIG. 5B on the same walker, thereby combining the advantages of both arrangements. The invention can thus be easily adapted to varying needs.

Figure 7:
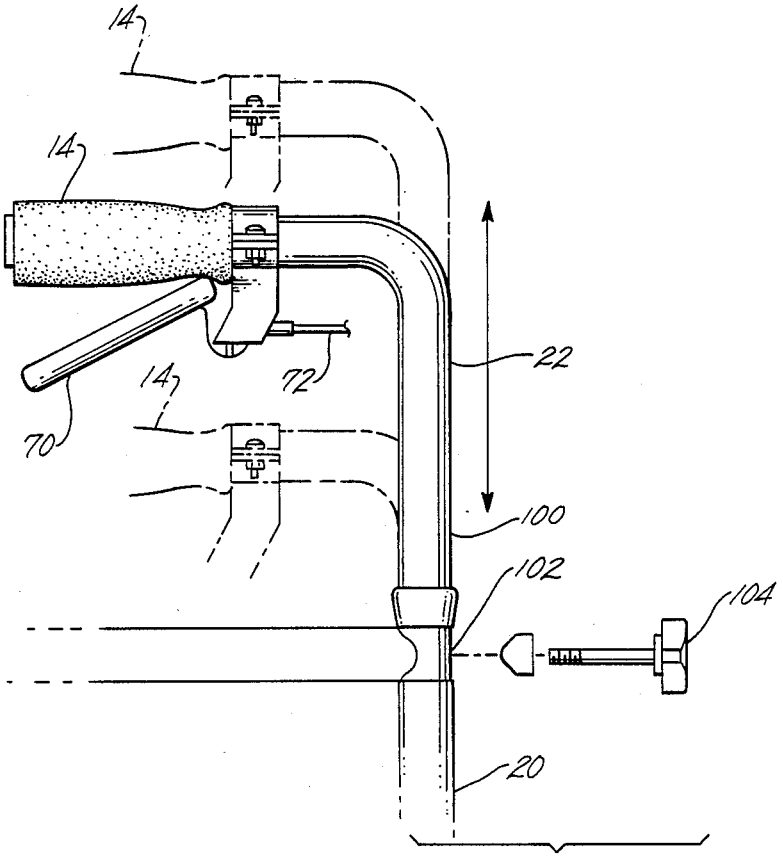
FIG. 7 is a detail side elevation view showing the adjustable push handle, brake lever and brake cable.

As shown in FIGS. 1 and 7, the push handles are adjustable up and down. The handle support tubes 22 slide in and out of the straight portion of the side frames 20. The support tubes are drilled with a series of holes 100 and the side frame is drilled with a single hole 102 to adjust the handles 14 up and down. To adjust the height of the handles, pin 104 is unscrewed from the side frame. The push handle support tube is then moved into the desired position with one of the holes 100 on the support tube aligned with the hole 102 in the side frame. Pin 104 is then reinserted by screwing it into hole 102 where it passes through apertures 100 on both sides of the support tube 22 and securely holds the tube in place.

Each push handle is thereby independently adjustable to a number of discrete positions depending on the needs of the user. In an alternate embodiment frictional engagements of the push handle tubes are contemplated permitting positioning of the height of the push handles at an infinite number of selectable positions. Again depending on the particular application, the push handle tubes can be mechanically linked to cause both handles to be positioned simultaneously rather than independently.

Figure 2:
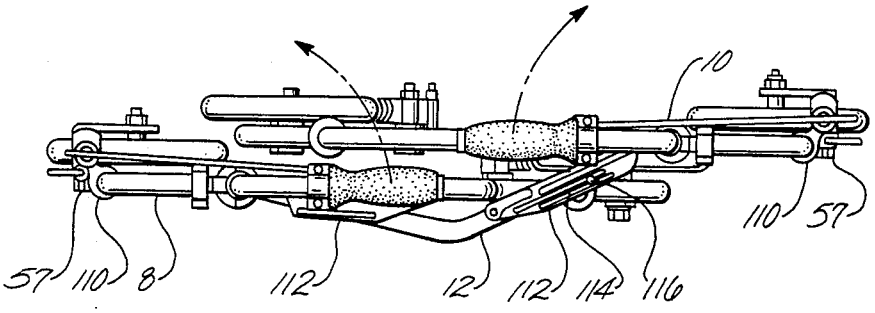
FIG. 2 is a plan view of the walker in the folded configuration.

FIG. 2 illustrates the folding action of the preferred embodiment of the present invention. The side frames 8 and 10 are mounted to crossbar 12 at pivot axes 110. The pivots allow the rears of the side frames to be moved inward and folded against each other, as shown in FIG. 7B.

When the walker is unfolded as shown in FIG. 1, the side frames are held in place with diagonal brace 112 which can be locked in the unfolded position. Brace 112 includes a slot 114 in which a pin 116 fixed to the crossbrace 12 slides. When the side frames are pushed towards each other, the diagonal brace pivots on the side frames and the pin slides in the slot allowing the side frames to move. The locking mechanism and other details of the diagonal brace are more clearly described in U.S. Pat. No. 3,945,389 which is hereby incorporated by reference. As shown in FIG. 2 when the walker is folded, the front and rear wheels are aligned. The walker, therefore, need not be carried but can be rolled on its own wheels to its storage location.

An important aspect of the walker of the present invention is the inclusion of a removable seat which enables the conversion of the walker to a miniwheelchair. In the presently preferred embodiment a length of flexible sturdy material 26 is removably mountable between the side frames.

The length of material is provided with the formed rods 30 attached along each side of the length of material. The rod is bent at each end at right angles to define mounting pins 51, 53 at each corner of the seat.

As indicated, seat collar supports 24 are clamped to the side frames at a height intermediate the top and bottom of the side frames. Collars 24 are split rings adopted to encircle the side frame tubes and to be clamped onto the side frames by means of clamping screws extending in a tangential direction through the collar and bridging a split in the ring.

Collars 24 are formed with extensions 31 so that in plan view the collars have a generally pear shaped configuration. Each extension 31 has a receptacle 32 drilled in it to receive the mounting pins 51, 53 on the seat supporting rod 30. The seat is positioned by inserting the pins 51, 53 into openings 32 with the result that the seat is stretched between the side frames to provide a sling seat for the user of the walker as is better seen in the phantom indications in FIG. 1.

The seat arrangement of the present invention improves on that available in prior art walkers by providing separate seat collars which are clamped onto the main frame of the walker itself without in any way invading or weakening the mechanical integrity of the framework of the walker. Thus the seat of the present invention is supported by the strongest mechanical elements of the walker.

In contrast, in the prior art attempts have been to suspend a removable seat from the spreader tubes or cross arms of a walker. In such approaches, large hooks are secured to the corners of a sling seat. Such hooks are then hung over the cross arms to suspend the seat across the center of the walker. The disadvantage is that such arrangements concentrate the user's weight in very small areas resulting in tearing of the seat fabric or bending or deforming of the side arms of the walker.

While this disclosure has described only one embodiment of the present invention, it will be obvious to one skilled in the art that many other embodiments are possible without departing from the spirit and scope of the present invention.

What is claimed is:

1. A rolling walker comprising:

(a) a horizontal cross-brace;

(b) side frames pivotally mounted at each end of the horizontal cross-brace, each side frame having a front leg, a rear leg and a horizontal element interconnecting the front and rear legs at the top thereof;

(c) a wheel mounted adjacent the bottom of each rear leg supporting the rear end of the walker;

(d) a wheel mounted at the bottom of each front leg for supporting the front end of the walker, said wheel being offset forward of the pivot axis of each side frame;

(e) a hand support having a free end and a fixed end mounted on and extending upwardly from the horizontal element of each side frame such that a handgrip mounted adjacent the free end of the support is positioned substantially midway between the front and rear wheels for supporting a person so that the person's weight is centered substantially equally between the front and rear wheels;

(f) said front wheels being normally axially pivotable such that the walker may be pushed in different directions; and (g) a locking lever operatively associated with each front wheel which is movable between a locked position which maintains each front wheel in an aligned front to rear non-pivoting position and an unlocked position wherein each wheel is freely pivotable about its mounting axis.

2. The rolling walker of claim 1 in which the cross-brace connects to the side frames at a point forward of the hand grips on the hand supports.

3. The rolling walker of claim 1 in which the side frames are pivotally mounted to the cross-brace so that the side frames may be folded towards each other.

4. The rolling walker of claim 3 in which the side frames include locking means which secure the side frames to the cross brace in the unfolded position.

5. The rolling walker of claim 1 in which the hand support is adjustable vertically to accommodate the height of different users.

6. The rolling walker of claim 1 including hand brake lever means and at least one wheel engaging element mounted on the side frame in braking relationship to a wheel and means interconnecting the hand brake lever means and the wheel engaging element whereby operation of the hand brake lever means produces braking of said wheel.

7. The rolling walker of claim 6 further comprising a pair of wheel engaging elements mounted at the bottom of each side frame adjacent each of the rear wheels and means for changing the orientation of the wheel engaging means to convert the walker between a brake normally ON mode and a brake normally OFF mode of operation.

8. The rolling walker of claim 1 including a seat supported by the side frames.

9. The rolling walker of claim 8 wherein the seat comprises a foldable substantially rectangular sheet having a pin at each corner, said pins removably engaging collar supports clamped to the side frames so that the seat may be extended between the side frames in use and folded to one side for storage.

10. A rolling walker comprising:

(a) a horizontal cross-brace;

(b) side frames pivotally mounted at each end of the horizontal cross-brace, each side frame having a front leg, a rear leg and a horizontal element interconnecting the front and rear legs at the top thereof;

(c) a wheel mounted adjacent the bottom of each rear leg for supporting the rear end of the walker;

(d) a wheel mounted at the bottom of each front leg forward of the cross-brace for supporting the front end of the walker, said wheel being offset forward of the pivot axis of said side frame;

(e) a hand support having a free end and a fixed end mounted on and extending upwardly from the horizontal element of said side frame, such that a handgrip mounted adjacent to the free end of the support is positioned substantially midway between the front and rear wheels for supporting a person so that the person's weight is centered substantially equally between the first and rear wheels;

(f) hand brake lever means pivotally attached to the hand supports;

(g) at least one wheel engaging element mounted on the side frame in braking relationship to a rear wheel;

(h) means interconnecting the hand brake lever means and the wheel engaging element whereby operation of the hand brake lever means produces braking of said wheel; and (i) means of changing the orientation of the wheel engaging means to convert the walker between a brake normally ON mode and brake normally OFF mode of operation.

* * * * *